US010526160B2

(12) United States Patent
Van Hoecke et al.

(10) Patent No.: US 10,526,160 B2
(45) Date of Patent: Jan. 7, 2020

(54) WINDING OF MULTIPLE ELONGATED ELEMENTS

(71) Applicant: NV Bekaert SA, Zwevegem (BE)

(72) Inventors: Hendrik Van Hoecke, Ostend (BE); Xinghua Liu, Jiangsu (CN); Erwin Vereecken, Kalken (BE); Valentijn Kuijken, Oostkamp (BE)

(73) Assignee: NV BEKAERT SA, Zwevegem (BE)

( * ) Notice: Subject to any disclaimer, the term of this patent is extended or adjusted under 35 U.S.C. 154(b) by 234 days.

(21) Appl. No.: 15/575,865

(22) PCT Filed: Mar. 30, 2016

(86) PCT No.: PCT/EP2016/056935
§ 371 (c)(1),
(2) Date: Nov. 21, 2017

(87) PCT Pub. No.: WO2016/192870
PCT Pub. Date: Dec. 8, 2016

(65) Prior Publication Data

US 2018/0127230 A1 May 10, 2018

(30) Foreign Application Priority Data

May 29, 2015 (WO) ..... PCT/CN2015/080248

(51) Int. Cl.
*B65H 54/02* (2006.01)
*B65H 59/36* (2006.01)
(Continued)

(52) U.S. Cl.
CPC ..... *B65H 54/026* (2013.01); *B65H 59/36* (2013.01); *B65H 59/388* (2013.01); *D07B 7/02* (2013.01);
(Continued)

(58) Field of Classification Search
CPC .... B65H 54/026; B65H 59/388; B65H 59/36; B65H 2701/38; B65H 2701/36; D07B 7/02; D07B 2301/258
See application file for complete search history.

(56) References Cited

U.S. PATENT DOCUMENTS 2,159,635 A * 5/1939 Ranney ..... B65H 59/16 242/411
2,417,780 A * 3/1947 Parvin ..... B21C 47/003 72/17.2
(Continued)

FOREIGN PATENT DOCUMENTS

CH 387 512 1/1965
DE 967 171 10/1957
(Continued)

OTHER PUBLICATIONS

International Search Report dated Jun. 9, 2016 in International (PCT) Application No. PCT/EP2016/056935.

*Primary Examiner* — William A. Rivera
(74) *Attorney, Agent, or Firm* — Wenderoth, Lind & Ponack, LLP.

(57) ABSTRACT

A system (10) for winding multiple elongated elements (12, 14) simultaneously under a substantially same tension on a single spool (16) comprises one pendulum arm (18) and one set of actuators (22) acting on the pendulum arm (18) and balancing with the sum of tensions of each elongated element (12, 14). The system (10) further comprises one or more balancing arms (26, 40): A first balancing arm (26) is attached to the pendulum arm (18), the other balancing arms (if any) are attached to the first balancing arm (26). Each balancing arm (26) is pivotable upon a balancing arm axis (28). A first set of one or more reversing pulleys (30) is positioned at one side of the first balancing arm axis (28) and a second set of one or more reversing pulleys (32) is
(Continued)

positioned at the other side of said balancing arm axis (28). Each of the reversing pulleys (30, 32) guides an elongated element (12, 14) to be wound.

10 Claims, 3 Drawing Sheets

(51) Int. Cl.
*B65H 59/38* (2006.01)
*D07B 7/02* (2006.01)

(52) U.S. Cl.
CPC ..... *B65H 2701/36* (2013.01); *B65H 2701/38* (2013.01); *D07B 2301/258* (2013.01)

(56) References Cited

U.S. PATENT DOCUMENTS 2,929,569 A * 3/1960 Detrick ..... B21C 49/00 242/474.9
3,350,022 A 10/1967 Bense et al.
3,533,358 A * 10/1970 Leuenberger ..... B63B 27/18 104/114
3,565,357 A * 2/1971 Takashi ..... B65H 54/2851 242/413.4
3,578,795 A * 5/1971 Polese ..... B65H 59/385 242/413.5
3,822,832 A 7/1974 Torii et al.
4,062,504 A * 12/1977 Kitazawa ..... B65H 19/14 242/530.2
4,604,860 A * 8/1986 Matsuura ..... D07B 1/0693 57/311
5,169,479 A * 12/1992 Hoddinott ..... B65H 65/005 156/353
5,657,941 A * 8/1997 Simons ..... B65H 23/1825 242/420.6
2001/0002561 A1* 6/2001 Shiraga ..... B23D 57/0053 83/13
2012/0018564 A1* 1/2012 Schmitz ..... B21C 47/003 242/419.8
2019/0224734 A1* 7/2019 Nguen ..... B21C 47/02

FOREIGN PATENT DOCUMENTS

| | | |
|---|---|---|
| DE | 31 06 947 | 4/1982 |
| EP | 0 780 333 | 6/1997 |
| EP | 1 516 861 | 3/2005 |
| GB | 1163983 | 3/1967 |
| JP | 5-78029 | 3/1993 |
| JP | 2012-126569 | 7/2012 |

* cited by examiner

WINDING OF MULTIPLE ELONGATED ELEMENTS

TECHNICAL FIELD

The invention relates to a system for winding multiple elongated elements simultaneously under a substantially same tension on single spool.

BACKGROUND ART

Assemblies and apparatus for winding a plurality of elongated elements such as wires, cables or cords on one spool are known in the art. However, the unwinding of a plurality of elongated elements from such a single spool, may cause difficulties and the subsequent twisting of the elongated elements, e.g. in a double-twisting machine, may lead to an unacceptable degree of fracture and processability problems.

The unwinding difficulties and the processability problems and fractures during the subsequent twisting may be due to a variation in diameter of the elongated elements during their winding, or may be due to the fact that elongated elements become entangled during their winding, or may be due to the fact that the elongated elements, although wound at the same time on the same spool, take different lengths on the spool. Other difficulties during the unwinding operations are due to different tensions in the individual elongated elements during the winding operation. According to Hooke's law, in case the tension on a first individual elongated element increases in comparison with the tension on a second individual elongated element, less material of the first individual elongated element will be wound since this first individual element gets more elongated.

In addition, tension measurement, particular tension measurement in-line, is expensive.

Prior art GB1163983B discloses a method for winding a plurality of elongated elements on one spool whereby it is aimed at keeping the winding lengths of the elongated elements substantially equal to each other despite some variations in diameter of the elongated element. The solution used to obtain substantially the same lengths is to increase the tension in elongated elements with an increased diameter in order to reduce the winding diameter and to decrease the tension in elongated elements with a decreased diameter in order to increase the winding diameter. A separation comb is mounted upstream the winding spool in order to avoid disentanglement of the neighboring elongated elements. But this prior art has its drawback. The tension difference between the elongated elements may cause unwinding difficulties during the unwinding process.

Prior art EP0780333A discloses an assembly for winding multiple elongated elements on a spool, where the tensions in the elongated elements are kept substantially constant and equal. In order to obtain constant and equal tensions, the assembly comprises following parts: a set of independently drivable capstans, one for each individual elongated element to be wound; a single spool where the plurality of elongated elements are to be wound; first monitoring means for measuring the tensions of each individual elongated element of a subgroup of the plurality of elongated elements; first control means for steering individually the revolution speed of the capstans driving the elongated elements of the subgroup such that said tensions remain substantially constant and substantially equal to each other. Before their winding on the spool, a comb is used to prevent the wires from entangling with each other and from jumping over each other. But this prior art also has its drawbacks. In this assembly, the tension of each elongated element is measured and controlled by an individual dancer arm. Because of the difference on manufacture, assembly, and calibration of the individual dancer arms, tension difference occurs between the elongated elements.

DISCLOSURE OF INVENTION

It is an objective of the present invention to avoid the drawbacks of the prior art.

It is another objective of the present invention to provide a system to wind two or more elongated elements on one spool with substantially equal tensions.

It is still another objective of the present invention to wind a plurality of elongated elements so that all elongated elements have exactly the same length.

It is a more specific objective of the present invention to avoid using one pendulum or dancer arm per elongated element.

It is a general objective of the present invention to avoid using too many tension controls.

According to the present invention there is provided a system for winding multiple elongated elements simultaneously under a substantially same tension on a single spool. The system comprises only one pendulum arm, and one set of actuators acting on the pendulum arm and balancing with the sum of tensions of each elongated element. The system further comprises one or more balancing arms: A first balancing arm is attached to the pendulum arm, the other balancing arms (if any) are attached to the first balancing arm. Each balancing arm is pivotable upon a balancing arm axis. A first set of one or more reversing pulleys is positioned at one side of the (first) balancing arm axis corresponding to the first balancing arm. A second set of one or more reversing pulleys is positioned at the other side of the first balancing arm axis. Each pulley of the first set and of the second set of one or more of the reversing pulleys guides an elongated element to be wound on the single spool.

The terms 'winding . . . simultaneously under a substantially same tension' mean that all the elongated elements are each wound under a substantially same tension at a given time. These terms do not mean that the tension under which all the elongated elements are wound remains constant in time. The purpose is to have substantially the same lengths on every elongated element on the spool.

The term "elongated elements" refers to elements the longitudinal dimension of which is more than hundred times larger than the cross-sectional dimensions. Common examples of elongated elements are round or flat steel wires, e.g. high carbon and low carbon steel wires, steel cords, textile yarns, etc.

The number of elongated elements wound by the system may be two, three, four, five, six or more.

Preferably there is only one actuator acting on the pendulum arm. This actuator can be a spring, a pneumatic cylinder, a hydraulic cylinder, or a weight.

In a particular embodiment of the system, the balancing arms are so designed that they divide the force from the actuator in equal tensions on each of the elongated elements.

In an embodiment of the system, the system may comprise a pendulum sensor for measuring the position of the pendulum arm.

The system may also comprise one or more balancing arm sensors for measuring the position of the balancing arms.

In a preferable embodiment, the system comprises reverse wheel sensors for measuring directly the position of the reversing wheels. In case of such wheel sensors the balancing arm sensors are not needed. The advantages of wheel sensors are that they are cheaper, that they do not need to be as precise as the balancing arm sensors and that their signals do not have to undergo calculations.

In an embodiment adapted for winding two elongated elements, the system has one balancing arm, also referred to as the 'first balancing arm' with a first balancing arm axis positioned on the pendulum arm. A first reverse pulley is positioned at one side of the first balancing arm and a second reverse pulley is positioned at the other side of the first balancing arm.

In an embodiment adapted for winding three elongated elements, the system has a first balancing arm with a first balancing arm axis positioned on the pendulum arm. The system further has a second balancing arm with a second balancing arm axis on one side of the first balancing arm. A first reverse pulley is positioned at one side of the second balancing arm, a second reverse pulley is positioned at the other side of the second balancing arm. A third reverse pulley is positioned at the other side of the first balancing arm.

In an embodiment adapted for winding four elongated elements, the system has a first balancing arm with a first balancing arm axis positioned on the pendulum arm. The system further has a second balancing arm with a second balancing arm axis on one side of the first balancing arm. A first reverse pulley is positioned at one side of the second balancing arm, a second reverse pulley is positioned at the other side of the second balancing arm. The system also has a third balancing arm with a third balancing arm axis at the other side of the first balancing arm. A third reverse pulley is positioned at one side of the third balancing arm, a fourth reverse pulley is positioned at the other side of the third balancing arm.

In a preferable embodiment of the system, for each balancing arm, the balancing arm axis is in line with the axes of rotation of the reverse pulleys positioned on the related balancing arm.

BRIEF DESCRIPTION OF FIGURES IN THE DRAWINGS

This invention will now be described into more detail with reference to the accompanying drawings.

Figure 4:
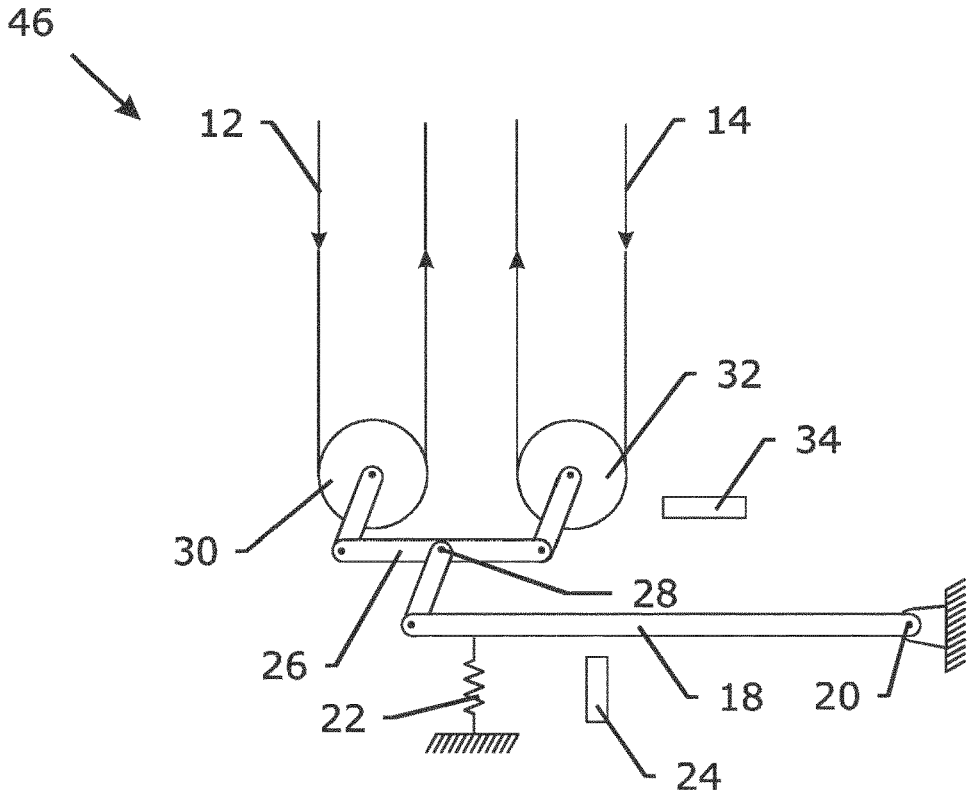

FIG. 4 schematically shows a preferable embodiment of a system to wind two elongated elements.

Figure 5:
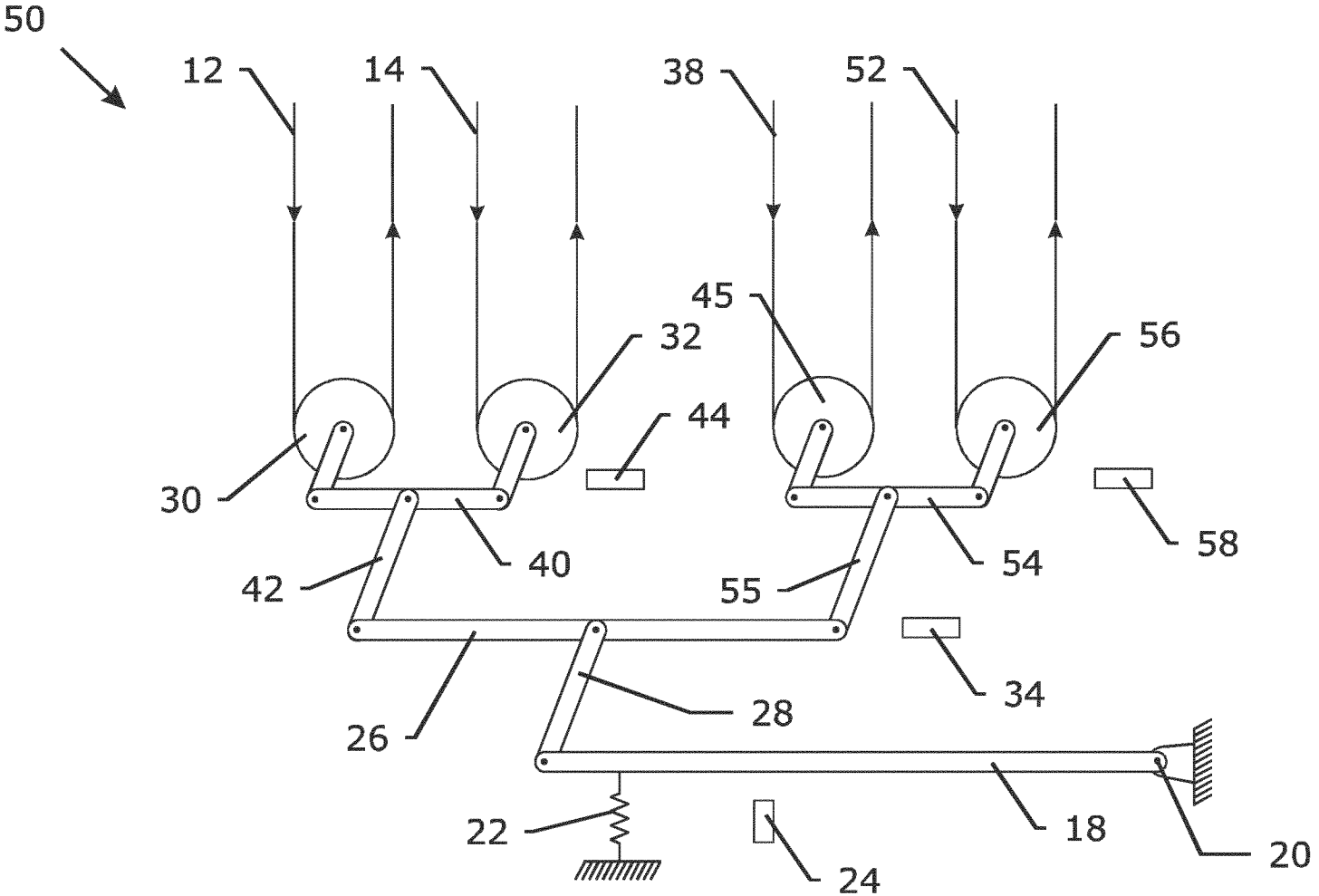

FIG. 5 schematically shows a preferable embodiment of a system to wind four elongated elements.

MODE(S) FOR CARRYING OUT THE INVENTION

Figure 1:
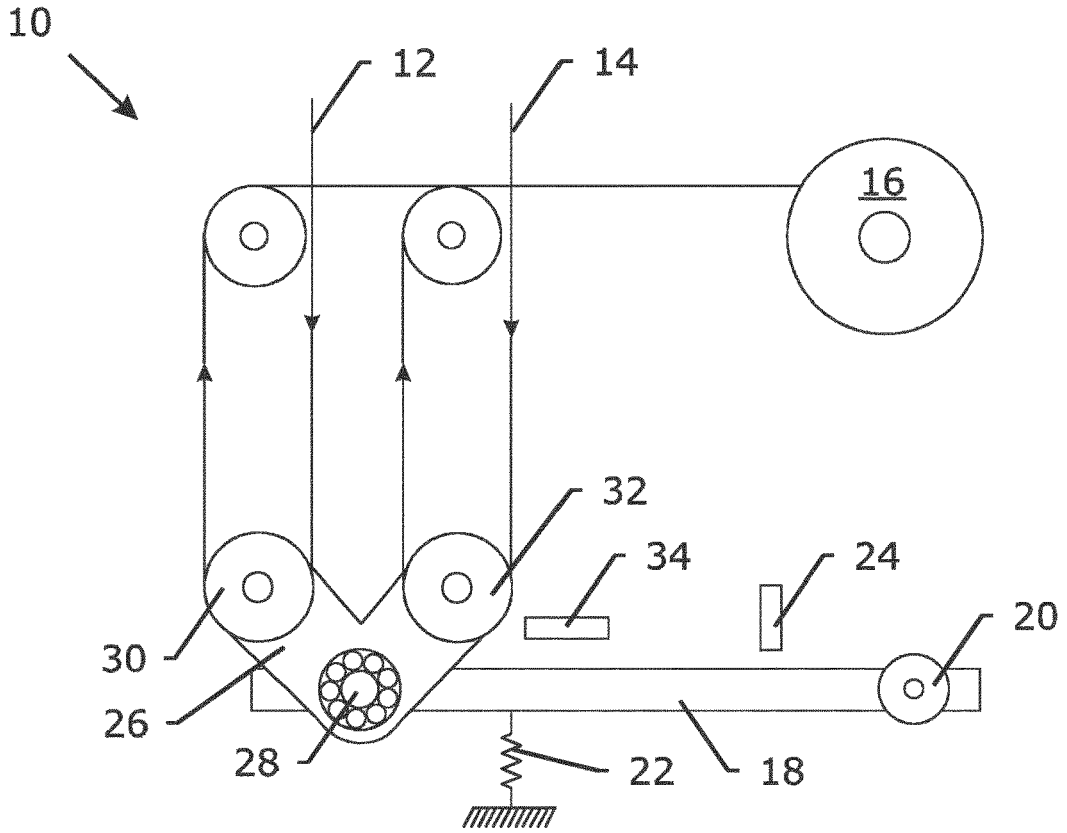
FIG. 1 shows a system to wind two elongated elements on one spool according to present invention.
Figure 2:
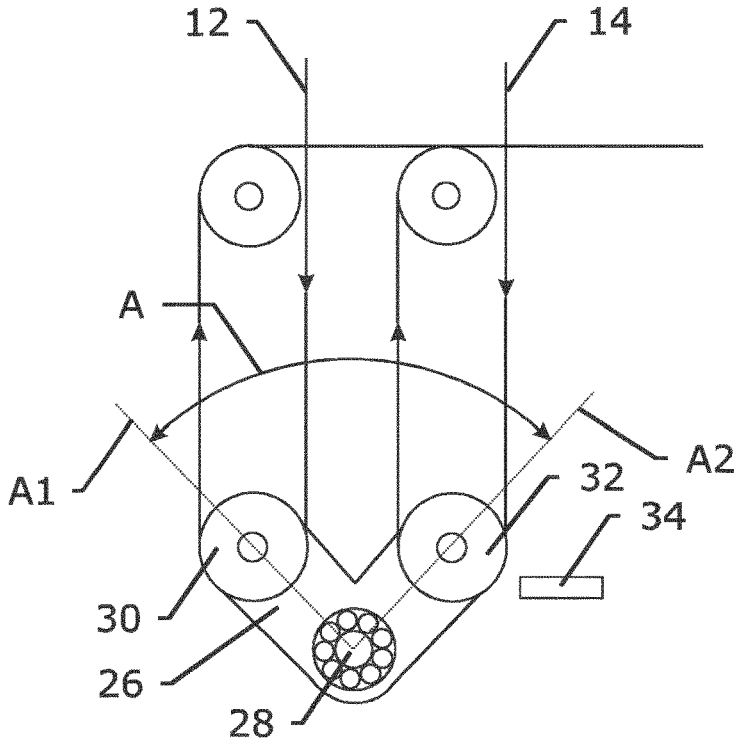
FIG. 2 shows an enlarged view of the part of FIG. 1.

FIG. 1 and FIG. 2 schematically show the set-up of a system 10 for winding a first wire 12 and a second wire 14 on a single wind-up spool 16. The system has a single pendulum arm 18 that is pivotable around a pendulum arm axis 20. A spring 22 acts as actuator on the pendulum arm 18. A pendulum sensor 24 measures the position of the pendulum arm 18. The sum of forces acting on both the first wire 12 and the second wire 14 is equal to the force of the spring 22.

A first and only balancing arm 26 is pivotable around a first balancing arm axis 28 that is positioned on the pendulum arm 18. At one end of the first balancing arm 26 is a first reverse pulley that guides the first wire 12. At the other end of the first balancing arm 26 is a second reverse pulley 32 that guides the second wire 14. A sensor 34 measures the position of the first balancing arm 26.

Referring to FIG. 2 only, A1 is a line connecting the axis of rotation of the first reverse pulley 30 with the first balancing arm axis 28. A2 is a line connecting the axis of rotation of the second reverse pulley 32 with first balancing arm axis 28. A is the angle between line A1 and line A2. As will be explained with respect to FIG. 4, A is preferably close to 180°, e.g. varying between 150° and 210°, e.g. between 160° and 200° and is most preferably equal to 180°.

Various control strategies or algorithms are possible to wind the two wires 12, 14 with the same tension and thus with the same length on the spool 16. A possible example is along following lines. The first wire 12 comes from a first drawing machine (not shown) and the second wire 14 comes from a second drawing machine (not shown).

The master control system may take into account the capstan of the first drawing machine. The rotation speed of the last downstream capstan of the first drawing machine may determine the rotation speed of the spool 16.

In a position as shown in FIG. 1, i.e. when the pendulum arm 18 is horizontal and the reverse pulleys 30 and 32 have the same height, the system is in an equilibrium position where the first wire 12 has half of the force exercised by spring 22 and the second wire 14 has the other halve of the force.

As soon as there is a deviation from this equilibrium position, the pendulum sensor 24 and the sensor 34 for the first balancing arm 26 will detect this deviation. The signals from sensor 24 and sensor 34 are then input for a calculated signal adapting the rotation speed of the last downstream capstan of the second wire 14.

Figure 3:
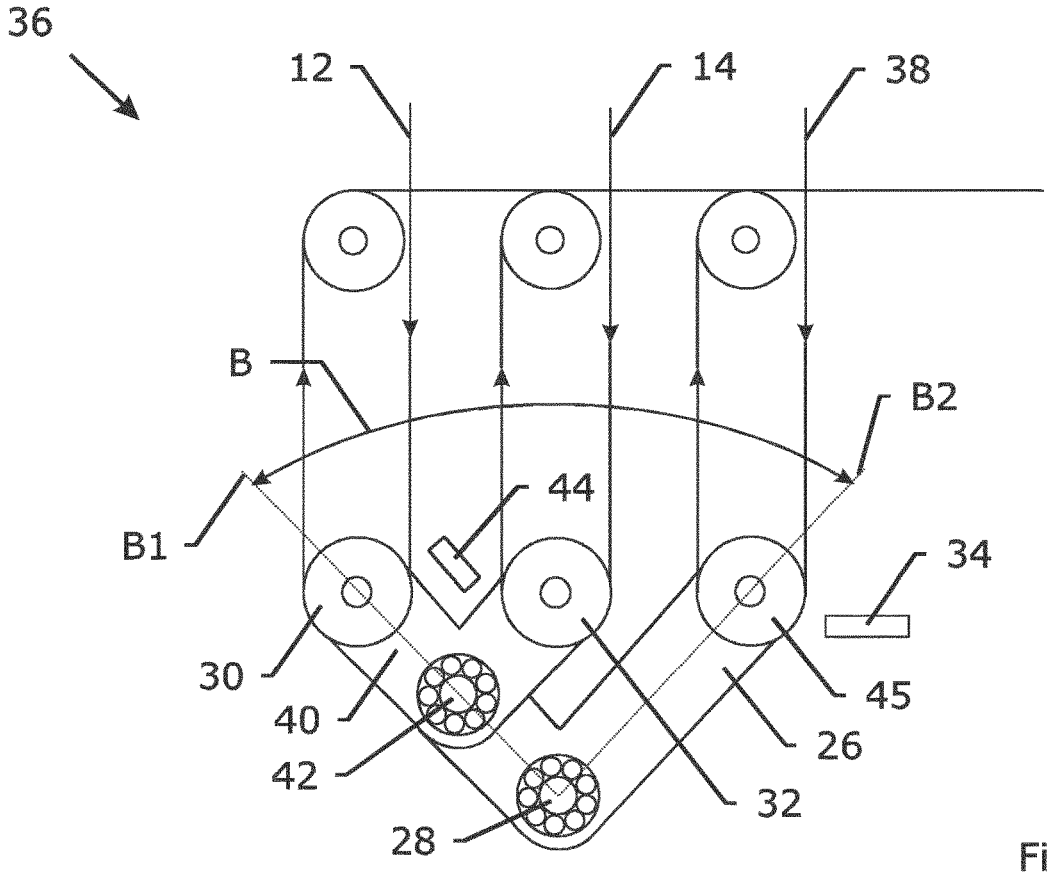
FIG. 3 shows an enlarged view of a system for winding three elongated elements on one spool.

FIG. 3 illustrates a system 36 for winding three wires 12, 14 and 38. A second balancing arm 40 is positioned through its second balancing arm axis 42 on one end of the first balancing arm. The second balancing arm 40 has, at one end, the first reverse pulley 30 and, at its other end, the second reverse pulley 32. A third reverse pulley 45 which is guiding the third wire 38 is positioned at the other end of the first balancing arm axis 26. A sensor 44 may monitor the position of the second balancing arm 40. B1 connects the axis of the first reverse pulley 30 with the first balancing arm axis 28. B2 connects the axis of the third reverse pulley 45 with the first balancing arm axis 28. B is the angle formed between B1 and B2. Preferably B ranges from 160° to 200°, most preferably B is equal to 180°.

FIG. 4 shows a preferred system 46 for winding two wires 12 and 14. The difference with the embodiment of FIGS. 1 and 2 is that the axes of rotation of the reverse pulleys 30, 32 are in line with the first balancing arm axis 28. In other words, the angle A of FIG. 2 is 180°. The advantage of this system is that the tensions on both wires 12 and 14 are always automatically equal, even if the first balancing arm 26 has rotated or pivoted away from its zero horizontal position that is shown on FIG. 4. So no further tension control system is needed here. Sensor 34 measuring the position of reverse pulley 32 is there for speed control of the pay-off of the second wire 14.

FIG. 5 shows a preferred system 50 for simultaneously winding four wires 12, 14, 38 and 52 on a single spool. A first balancing arm 26 is positioned via its first balancing arm axis 28 on the pendulum arm 18. A second balancing arm 40 is positioned through its second balancing arm axis 42 on one end of the first balancing arm 26. The second balancing arm axis has at one end the first reverse pulley 30 and at its other end the second reverse pulley 32. A third balancing arm 54 is positioned through its third balancing arm axis 55 on the first balancing arm 26. The third balancing arm 54 has at its one end a third reverse pulley 45 that guides the third wire 38 and, at its other end, a fourth reverse pulley 56 that guides the fourth wire 52. A sensor 58 may measure the position of the fourth reverse pulley 54.

The system may be useful to wind multiple elongated elements which have a limited elongation in the elastic field, e.g. metal filaments, metal wires, metal cords, steel wires, steel cords, copper wires . . . . These elongated elements preferably have an elastic modulus E of more than 50.000 MPa, e.g. more than 100.000 MPa, e.g. more than 150.000 MPa. The system is also useful to wind more elastic elongated elements, such as synthetic filaments or textile yarns.

LIST OF REFERENCE NUMBERS

10 system for winding two wires
12 first wire
14 second wire
16 single spool where wires are wound
18 pendulum arm
20 pendulum arm axis
22 spring as actuator
24 pendulum sensor
26 first balancing arm
28 first balancing arm axis
30 first reverse pulley
32 second reverse pulley
34 sensor for first balancing arm
A1 line through axis of first reverse pulley and first balancing arm axis
A2 line through axis of second reverse pulley and first balancing arm axis
A angle between A1 and A2
36 system for winding three wires
38 third wire
40 second balancing arm
42 second balancing arm axis
44 sensor for second balancing arm axis
45 third reverse pulley
131 line between axis of first reverse pulley and first balancing arm axis
B2 line between axis of third reverse pulley and first balancing arm axis
B angle between B1 and B2
46 preferred system for winding two wires
50 preferred system for winding four wires
52 fourth wire
54 third balancing arm
55 third balancing arm axis
56 fourth reverse pulley
58 sensor for third balancing arm

The invention claimed is:

1. A system for winding multiple elongated elements simultaneously under a substantially same tension on a single spool, said system comprising one pendulum arm, said system further comprising one set of actuators acting on said pendulum arm and balancing with the sum of tensions of each elongated element, said system further comprising one or more balancing arms, a first balancing arm being attached to said pendulum arm, the other balancing arms being attached to said first balancing arm, each balancing arm being pivotable upon a balancing arm axis, a first set of one or more reversing pulleys being positioned at one side of a first balancing arm axis, a second set of one or more reversing pulleys being positioned at the other side of the first balancing arm axis, each pulley of said first set and of said second set of one or more of said reversing pulleys guiding an elongated element to be wound on said single spool.

2. A system according to claim 1, wherein there is only one actuator.

3. A system according to claim 2, wherein said balancing arms are designed so that they divide the force from the actuator in equal tensions on each of the elongated elements.

4. A system according to claim 1, wherein said system further comprises a pendulum sensor for measuring the position of the pendulum arm.

5. A system according to claim 1, wherein said system further comprises one or more balancing arm sensors for measuring the position of the balancing arms.

6. A system according to claim 1, wherein said system further comprises reverse wheel sensors for measuring the position of the reversing wheels.

7. A system according to claim 1, said system being adapted for winding two elongated elements, said system having a first balancing arm, a first reverse pulley positioned at one side of said first balancing arm and a second reverse pulley positioned at the other side of said first balancing arm.

8. A system according to claim 1, said system being adapted for winding three elongated elements, said system having a first balancing arm with a first balancing arm axis on said pendulum arm, said system having a second balancing arm with a second balancing arm axis on one side of said first balancing arm, said system having a first reverse pulley at one side of the second balancing arm and a second reverse pulley at the other side of the second balancing arm, said system further having a third reverse pulley at the other side of said first balancing arm.

9. A system according to claim 1, said system being adapted for winding four elongated elements, said system having a first balancing arm with a first balancing arm axis on said pendulum arm, said system having a second balancing arm with a second balancing arm axis on one side of said first balancing arm, said system having a third balancing arm with a third balancing arm axis on the other side of said first balancing arm, said system having a first reverse pulley at one side of the second balancing arm and a second reverse pulley at the other side of the second balancing arm, said system further having a third reverse pulley at one side of the third balancing arm and a fourth reverse pulley at the other side of the third balancing arm.

10. A system according to claim 1, wherein for each balancing arm, the balancing arm axis is in line with the axes of rotation of the reverse pulleys attached to the related balancing arm.

* * * * *